US005159804A

United States Patent [19]

Schippers et al.

[11] Patent Number: 5,159,804

[45] Date of Patent: Nov. 3, 1992

[54] METHOD AND APPARATUS FOR TRANSFERRING A YARN TO A WINDING STATION OF A TEXTILE MACHINE

[75] Inventors: Norbert Schippers; Hans Raasch; Heinz-Dieter Göbbels, all of Mönchengladbach; Maximilian Preutenborbeck, Aachen, all of Fed. Rep. of Germany

[73] Assignee: W. Schlafhorst AG & Co., Mönchengladbach, Fed. Rep. of Germany

[21] Appl. No.: 580,328

[22] Filed: Sep. 10, 1990

[30] Foreign Application Priority Data

Sep. 9, 1989 [DE] Fed. Rep. of Germany ..... 3930136

[51] Int. Cl.[5] ..... D01H 13/04; D01H 9/10

[52] U.S. Cl. ..... 57/261; 57/263; 57/264; 242/35.6 R

[58] Field of Search ..... 57/261, 263-264, 57/279, 417, 313; 242/35.5 A, 35.5 R, 36, 35.6 R

[56] References Cited

U.S. PATENT DOCUMENTS

| | | | |
|---|---|---|---|
| 4,078,372 | 3/1978 | Stahlecker | 57/264 X |
| 4,109,450 | 8/1978 | Yoshida et al. | 242/35.5 R X |
| 4,120,140 | 10/1978 | Raascle et al. . | |
| 4,777,790 | 10/1988 | Raasch | 57/261 X |
| 4,915,315 | 4/1990 | Kamp et al. | 242/36 X |

*Primary Examiner*—Daniel P. Stodola

*Assistant Examiner*—William Stryjewski

*Attorney, Agent, or Firm*—Herbert L. Lerner; Laurence A. Greenberg

[57] ABSTRACT

A method for transferring a yarn after a yarn break to a normal yarn travel position at a textile machine winding station including making a yarn connection between a yarn supply point and a takeup bobbin and subsequently transferring the yarn to the normal yarn travel position at a transfer point at the reciprocating yarn guide with a tranfer motion of a yarn transfer device of a device that re-establishes yarn travel. The chronological course of the making of the yarn connection and the transverse motion of the yarn guide are monitored. The tranfer motion of the yarn transfer device and the transverse motion of the yarn guide are adapted to one another as a function of the chronological course for causing the yarn and the yarn guide to substantially simultaneously arriving at the transfer point. An apparatus for performing the method includes a first device for monitoring reciprocation of the yarn guide to a yarn tranfer point. A second device detects and processes signals from the first device and ascertains the time remaining for the guide to reach the transfer point. A third device which re-establishes a yarn connection has a device for transferring the yarn to the normal yarn travel position at the transfer point and a fourth device for chronologically adapting the making of the yarn connection to the motion of the yarn transfer device and initiating the transfer motion of the yarn transfer device as a function of other signals from the second device.

9 Claims, 7 Drawing Sheets

METHOD AND APPARATUS FOR TRANSFERRING A YARN TO A WINDING STATION OF A TEXTILE MACHINE

The invention relates to a method and apparatus for transferring a yarn to normal yarn travel at a winding station of a textile machine after a yarn break, in which, after a yarn connection has been made between a yarn supply point and a takeup bobbin, the yarn is transferred to its normal yarn travel position at a reciprocating yarn guide at the winding station, by a yarn transfer device of a device that re-establishes yarn travel.

Textile machines with winding stations include not only bobbin winders but also open-end spinning machines, air spinning machines or twisting machines. If the yarn travel at one of those machines is interrupted then, in the case of bobbin winders, it must be re-established by connecting the lower yarn to the upper yarn. That can be performed by splicing or knotting. In spinning machines, on the other hand, a yarn is guided to the spinning station and pieced again there.

As a rule, making a yarn connection with the yarn supply point by splicing, knotting or repiecing is performed at a spinning station, outside normal yarn travel. In bobbin winders, the yarn connection is re-established in a knotting or splicing apparatus at the winding station itself, or in an apparatus that travels back and forth past a number of winding stations and performs corresponding services. In open-end spinning machines, repiecing as a rule is performed with the aid of a so-called repiecing carriage, which serves a number of spinning stations.

Once the yarn connection is re-established between the takeup bobbin and the yarn supply point, the yarn must be returned to its normal yarn travel position. In bobbin winders, the yarn is taken out of the knotting or splicing device and transferred to the yarn guide for storage on the bobbin package. In open-end spinning machines, the pieced yarn is transferred from the piecing device of the piecing carriage to the unreeling roller of the spinning station and to the yarn guide.

German Patent DE-PS No. 26 20 805 discloses a method and an apparatus for piecing a yarn on an open-end spinning machine. That patent introduces a program that controls all of the processes involved in repiecing. When the yarn travel is re-established, thicker locations or slubs can form on the takeup bobbin, which reduce the quality or in other words impair the unreeling behavior of the cross-wound bobbin, or cheese.

It is accordingly an object of the invention to provide a method and an apparatus for transferring a yarn to a winding station of a textile machine, which overcome the hereinaforementioned disadvantages of the heretofore-known methods and devices of this general type and in which no reductions in quality that impair the unreeling behavior of the bobbin occur.

With the foregoing and other objects in view there is provided, in accordance with the invention, a method for transferring a yarn after a yarn break to a normal yarn travel position at a textile machine winding station having a reciprocating yarn guide with a transverse motion, which comprises making a yarn connection between a yarn supply point and a takeup bobbin, subsequently transferring the yarn to the normal yarn travel position at a transfer point at the reciprocating yarn guide with a transfer motion of a yarn transfer device of a device that re-establishes yarn travel, monitoring the chronological course of the making of the yarn connection and the transverse motion of the yarn guide, and adapting, tuning or synchronizing the transfer motion of the yarn transfer device and the transverse motion of the yarn guide to one another as a function of the chronological course for causing the yarn and the yarn guide to substantially simultaneously arrive at the transfer point of the yarn.

The making of a yarn connection in the ensuing transfer of the yarn to normal yarn travel at a winding station, and the transverse motion of the yarn guide to which the yarn is to be transferred have previously taken place concurrently with, but completely separately from one another, without either process being adapted to the other. The resultant problems in yarn positions can be effectively avoided if the making of the yarn connection and the transverse motion of the yarn guide are monitored as to their chronological course, and if as a function thereof the transfer motion of the yarn transfer device and the transverse motion of the yarn guide are adapted to one another in such a way that the yarn and the yarn guide arrive substantially simultaneously at the transfer point of the yarn.

Agreement of the time of arrival of the yarn and yarn guide at the transfer point is ideal. Since an ideal setting of this kind can only be achieved at great expense, the concept according to the invention is adequately carried out even by having the yarn guide and the yarn arrive at the transfer point substantially simultaneously. In other words, the yarn may arrive slightly before, but not after, the yarn guide.

In accordance with another mode of the invention, there is provided a method which comprises initiating the transfer of the yarn to the yarn guide whenever the time remaining until the transfer point is reached is equal to the time required for the transfer motion of the yarn transfer device to the transfer point, during a round trip or reciprocating or back and forth motion, during a double stroke, or during an integral multiple of a round trip of the yarn guide.

In accordance with a further mode of the invention, there is provided a method which comprises detecting the reciprocating motion of the yarn guide with sensors; emitting pulses from the sensors upon detecting a reciprocating motion of the yarn guide; ascertaining the time for one round trip and ascertaining the direction of the motion of the yarn guide with the pulses; and initiating the transfer of the yarn by the yarn transfer device toward the transfer point as a function of a given number of pulses, having a total duration which must be equal to the required time for the motion of the yarn transfer device to the transfer point.

A chronologically adapted yarn transfer of this kind can be effected only if both the transverse motion of the yarn guide and the making of the yarn connection are chronologically monitored. To this end, as means for monitoring the motion of the yarn guide, sensors may be installed at the reversal points that emit pulses whenever the yarn guide reaches them. The time elapsed between pulses is required by the yarn guide for either half of a round trip. After a pulse is emitted, it is accordingly advantageously known in which direction the yarn guide is moving and how much time will elapse until it arrives at its second reversal point. From the time that has elapsed since the emission of the most recent pulse it can also be determined what the particular position of the yarn guide is at precisely that instant. The times of the respective back and forth motions of the yarn guide are detected, stored in memory and added up.

If the motions of the yarn guide and yarn transfer device are to be adapted to one another, then the making of the yarn connection must be monitored beforehand as well. The times required for making a yarn connection by piecing or splicing are set, if these processes are performed by automatic equipment, which is the case as a rule. Through the use of the times for performing the yarn connection dictated by mechanical means, such as cam plates, or electronic means, such as pulse transducers, the instant at which a yarn connection is made and the yarn is taken up by the yarn transfer device can be calculated and predicted. A rapid transfer of the yarn to the yarn guide must take place no later than from that instant, so that waiting times with the attendant laps on the coil, which impair the yarn quality and later impair the unreeling process, do not occur.

A time will also be set for the transfer motion of the yarn transfer device to the transfer point of the yarn, and this time is equivalent to a very specific number of pulses. Accordingly, the yarn transfer device is not set into motion until the time available for the yarn guide to arrive at the transfer point is precisely as long as the time required for the yarn transfer device to proceed from its starting point to the transfer point. By monitoring the yarn guide and the making of the yarn connection, it is advantageously possible for the initiation of the yarn transfer not to take place until it is assured that the yarn guide and the yarn are arriving substantially simultaneously at the transfer point, so that there is no waiting time whatever for the yarn. The yarn is grasped directly by the yarn guide, and a deposition of the yarn on the bobbin in accordance with the transverse motion of the yarn guide necessarily takes place.

In accordance with an added mode of the invention, there is provided a method which comprises transferring the yarn to the yarn guide at the same transfer point each time. As a rule, this will already be true if the yarn is transferred by means of an apparatus installed in the applicable winding station or by means of a mobile server device. If the transfer of the yarn always occurs at the same transfer point, then the time required for the yarn guide to reach the transfer point can already be ascertained in advance.

In accordance with an additional mode of the invention, there is provided a method which comprises locating the transfer point at a slight distance before or ahead of a reversal point of the yarn guide. When the yarn guide grasps the yarn, this takes place abruptly as a rule, since the yarn guide is moving at high speed. The yarn is already deflected ahead of the reversal point, and it only covers a short additional distance until the reversal point of the yarn guide, so that the additionally occurring tensile strain on the yarn is only briefly operative at the instant of transfer.

With the objects of the invention in view there is also provided, in a textile machine having a winding station with a yarn supply point, a takeup bobbin, and a reciprocating yarn guide for the takeup bobbin, an apparatus for transferring a yarn to a normal yarn travel position after a yarn break, comprising first means for monitoring reciprocation of the yarn guide to a yarn transfer point and issuing signals; signal lines connected to the first means; second means or an apparatus connected to the signal lines for detecting and processing the signals, ascertaining the time still remaining for the yarn guide to reach the yarn transfer point and issuing other signals; third means or an apparatus for re-establishing a yarn connection between the takeup bobbin and the yarn supply point, the third means having a yarn transfer device for transferring the yarn to the normal yarn travel position at the transfer point, the third means having fourth means for chronologically adapting the making of the yarn connection to the motion of the yarn transfer device; another signal line connected between the second and fourth means for initiating the transfer motion of the yarn transfer device as a function of the other signals.

In accordance with a concomitant feature of the invention, the first means for monitoring the reciprocation of the yarn guide are pulse-emitting sensors.

Other features which are considered as characteristic for the invention are set forth in the appended claims.

Although the invention is illustrated and described herein as embodied in a method and an apparatus for transferring a yarn to a winding station of a textile machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
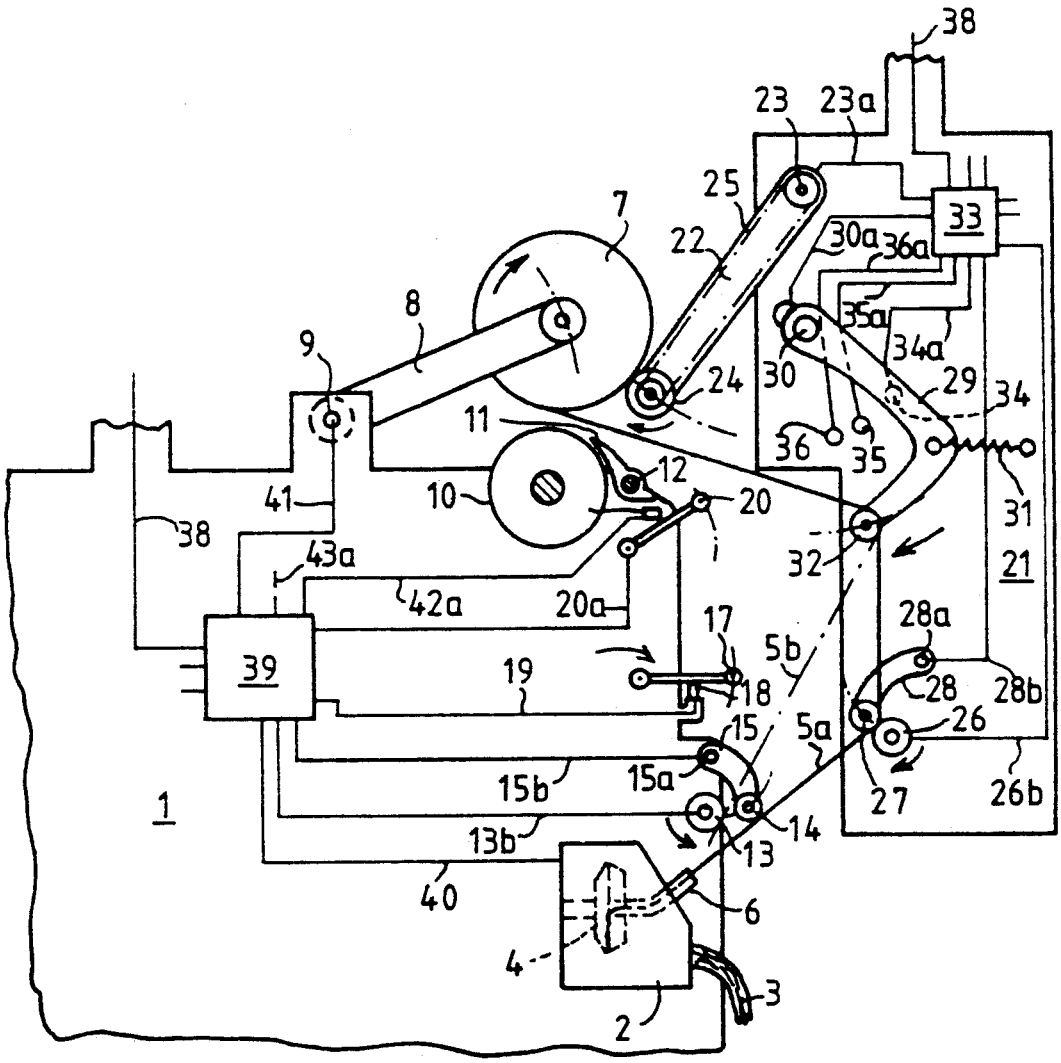
FIG. 2 is a fragmentary, diagrammatic, side-elevational view illustrating a payout of a re-pieced yarn by a piecing apparatus.
Figure 3A:
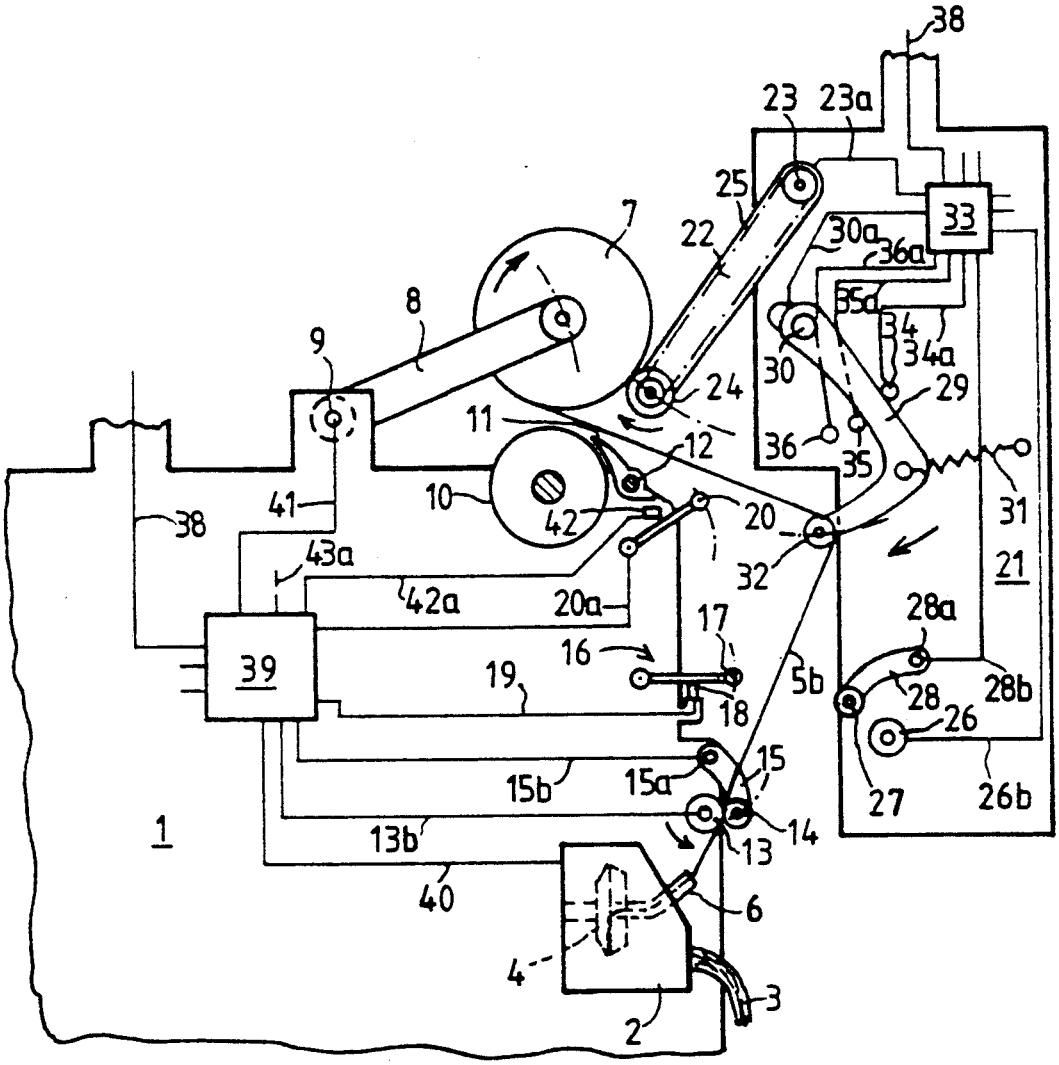
Figure 3B:
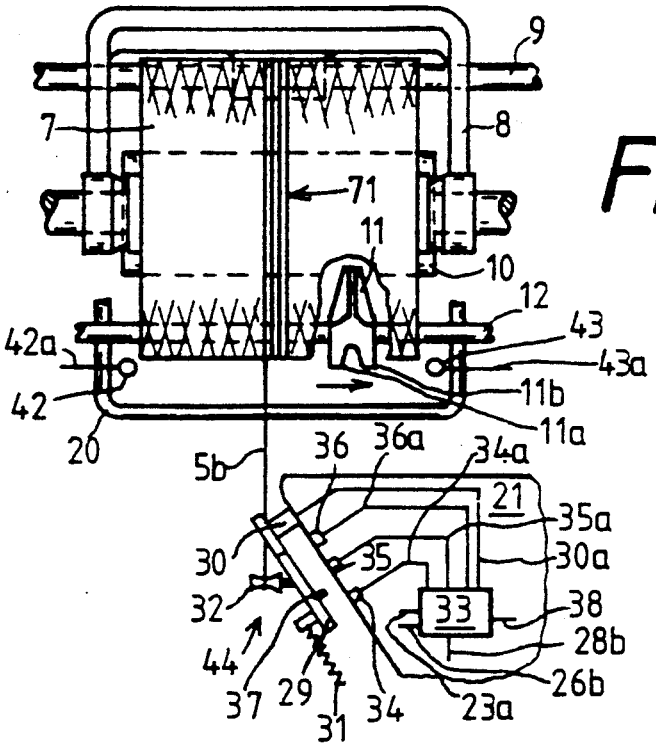
Figure 4B:
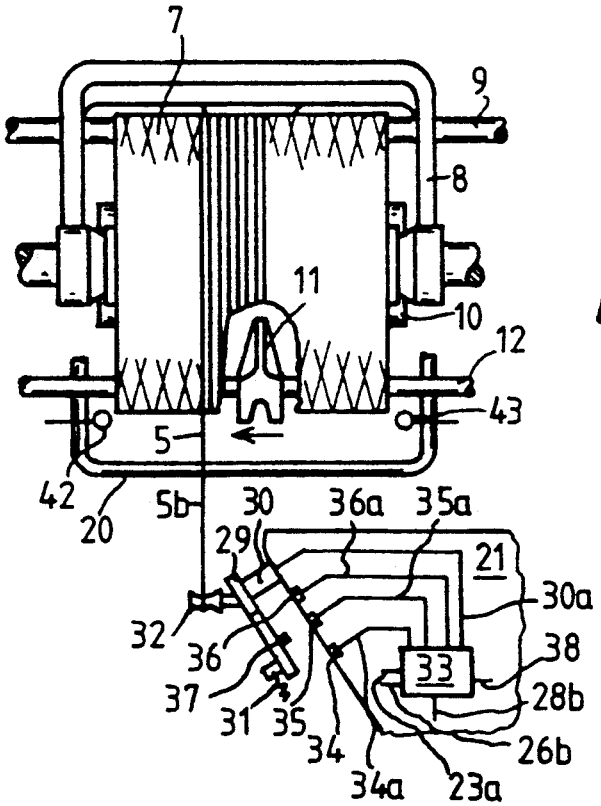
Figure 4A:
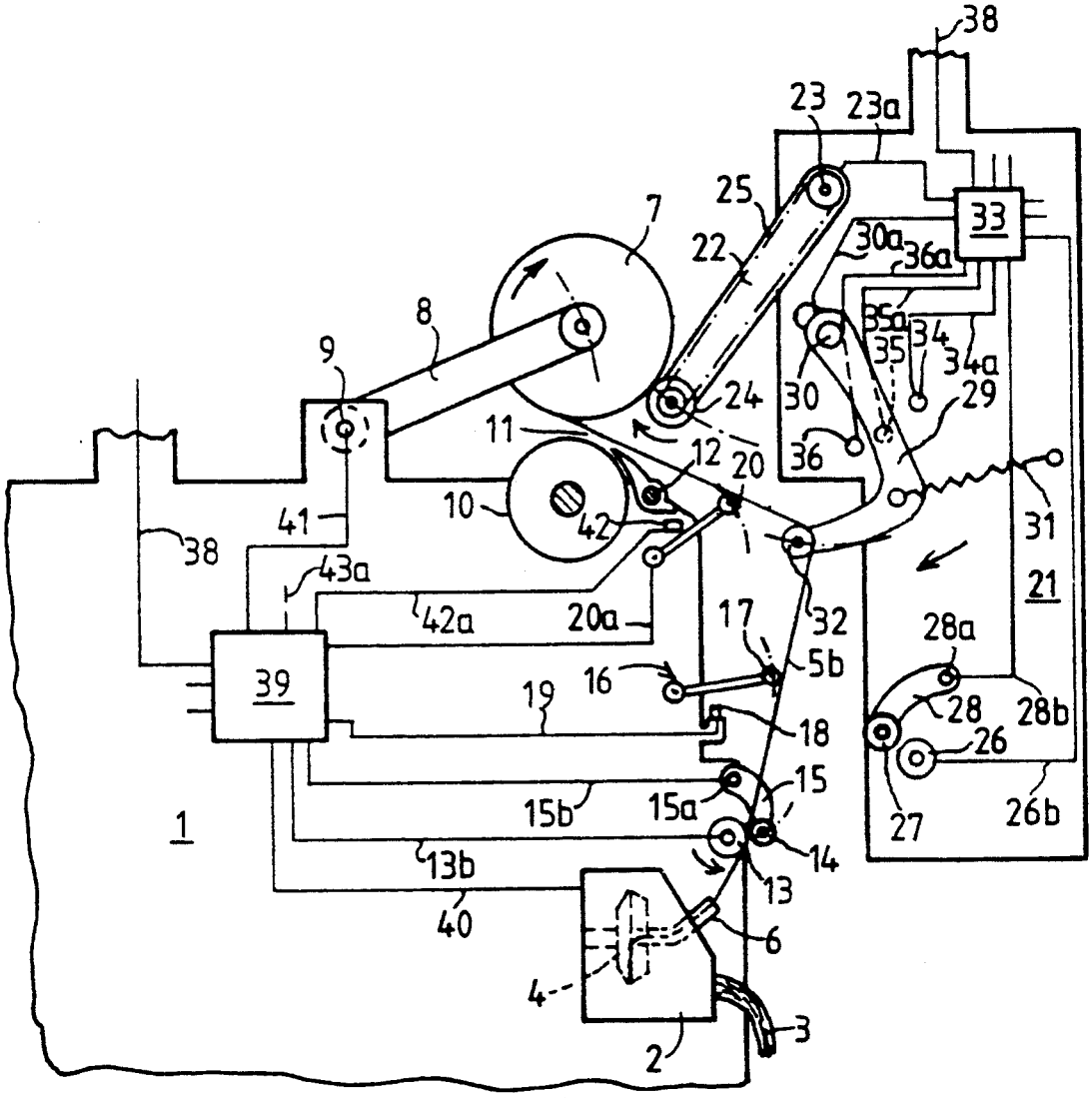

FIG. 3*a* is a view similar to FIG. 2 illustrating a transfer to takeup rollers of a spinning station;

FIG. 3*b* is an enlarged, fragmentary, top-plan view of a piecing apparatus and a bobbin, demonstrating the course taken by the yarn;

FIG. 4*a* is another view similar to FIG. 2 illustrating the instant at which the yarn travel is re-established;

FIG. 4*b* is a view similar to FIG. 3*b* showing the situation of FIG. 4*a;*

Figure 5A:
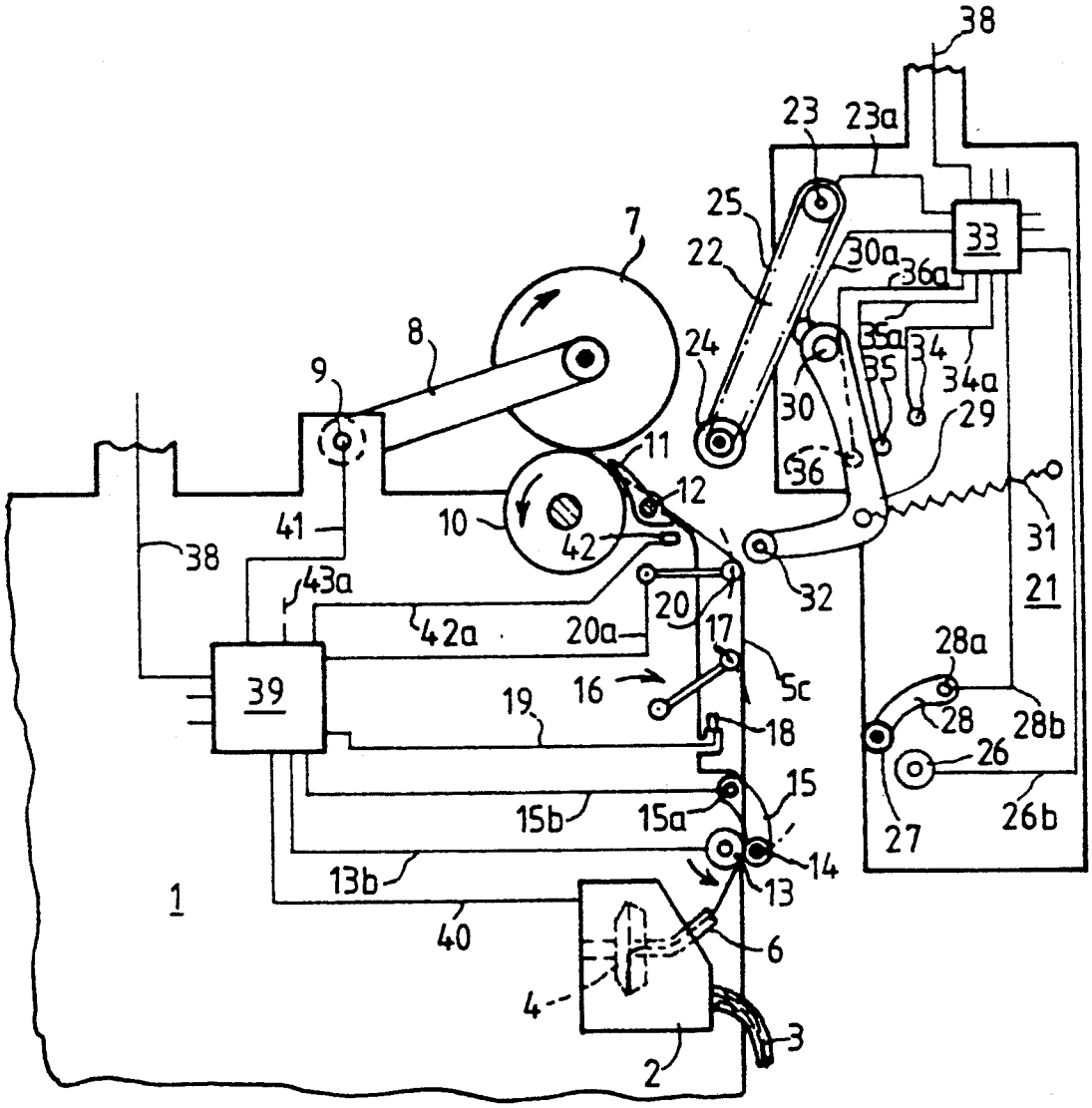
Figure 5B:
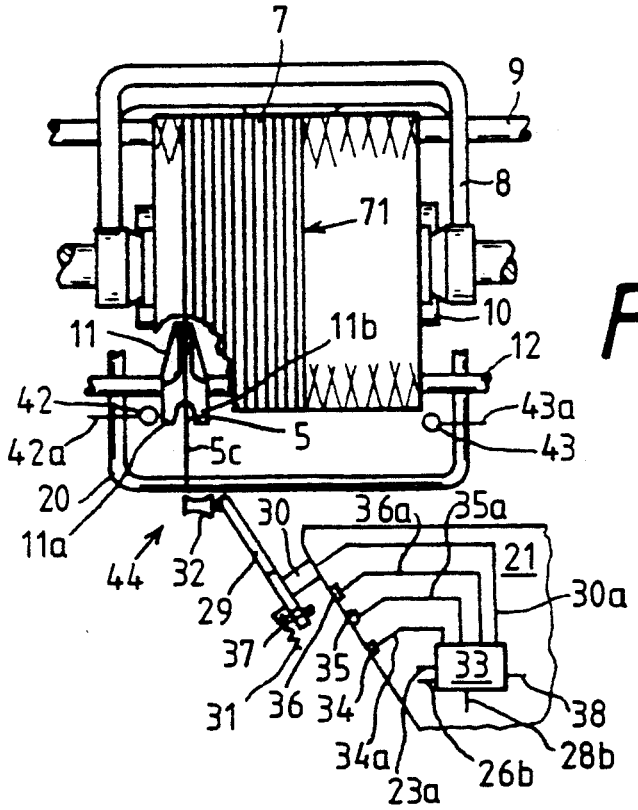

FIG. 5*a* is a further view similar to FIG. 2 illustrating the instant of yarn transfer to the yarn guide; and FIG. 5*b* is another view similar to FIG. 3*b* showing the situation of FIG. 5*a*.

Referring now to the figures of the drawing in detail and first, particularly, to FIG. 1 thereof, there is seen a flow chart with which the method for yarn transfer according to the invention will be explained in further detail. Three configurations of the yarn with respect to the yarn guide have been selected for this purpose.

Figure 1:
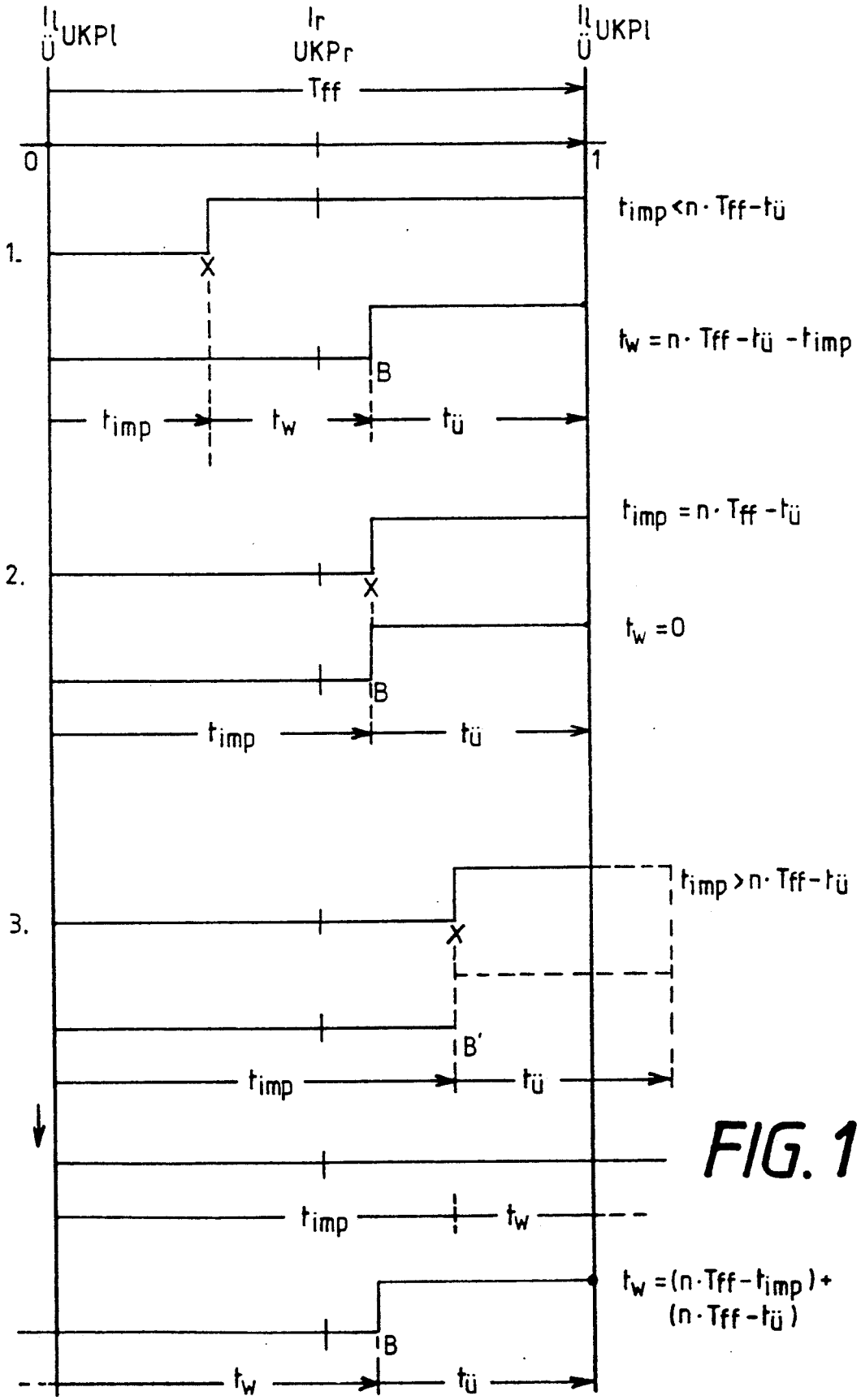
FIG. 1 is a flow chart illustrating the steps of the method for operating the apparatus.

In the flow chart shown in FIG. 1, the following symbols and designations have been used:

UKP1=left reversal point

UKPr=right reversal point $I_l$, $I_r$=pulse emission by recording of the yarn guide at the various reversal points Ü=transfer point X=yarn connection re-established B=beginning of yarn transfer B'=yarn transfer impossible $T_{ff}$=time for one round trip (double stroke) of the yarn guide n=(integral) number of round trips of the yarn guide (in the exemplary embodiment, n=1)

$t_{imp}$=time elapsed since the most recent pulse emission $t_w$=waiting time until beginning of yarn transfer tü=time required for the transfer of the yarn In the flow chart of FIG. 1, the functional courses in the transfer of the yarn to the yarn guide are plotted on a horizontal time axis. The functional courses begin at the time $T_{ff}=0$. At that instant, the yarn guide is at the left reversal point UKP1, where a pulse $I_l$ is emitted by means for monitoring the transverse motion of the yarn guide, for instance an optical sensor. Thus means for detecting and storing the reciprocation times for the yarn guide, or in other words, the time until the yarn guide again reaches the same sensor after a single round trip or after the predetermined integral multiple thereof, such as a clock that measures the time elapsed for a round trip of the yarn guide, or an integral number of multiple round trips of the yarn guide, are activated in the control apparatus of the textile machine. In the present example, n=1 is intended. This assumption simplifies the explanation of the flow chart.

After one round trip of the yarn guide, accordingly after it has passed the right reversal point UKPr, it reaches the left reversal point again. At that instant, the time $T_{ff}$ has elapsed. The yarn guide trips a new pulse $I_l$.

A first example of a yarn transfer is as follows:

Even before the yarn guide has reached the right reversal point (UKPr), the yarn connection has been re-established at a time X, and the yarn is ready for transfer to the yarn guide. Up to that time, the time $t_{imp}$ out of the total time for a round trip of the yarn guide, $T_{ff}$, has elapsed. The time tü, which is the time required for the transfer of the yarn to the yarn guide, is machine-specific and is defined by the mechanical processes involved in the transfer. Accordingly, it is invariable.

In order to provide a simpler description of the flow chart, the transfer point has been placed at the left reversal point (UKP1). A transfer of the yarn should accordingly take place only when the yarn guide is at the left reversal point.

Since the control device for transfer of the yarn not only has the clock but also a computer for ascertaining the time remaining until the transfer point is reached during one round trip, or multiple round trips of the yarn guide, the instant B at which the transfer of the yarn must be initiated can be ascertained precisely. From the instant X, at which the yarn connection is re-established, a waiting time $t_w$ then elapses until the beginning of yarn transfer at the time B. The transfer time tü which is defined by the mechanical process for carrying the yarn to the transfer point and for transfer to the yarn guide, elapses from that instant on.

The condition, on which the transfer of the yarn can still be effected within the time $T_{ff}$ for one round trip of the yarn guide, is that $t_{imp}$ must be less than the difference between the time for one round trip, or the nth number of round trips of the yarn guide, and the transfer time.

The second case reproduces the ideal situation for the transfer of the yarn to the yarn guide. At the time X, at which the yarn connection has been re-established, the time remaining for the yarn guide until it reaches the transfer point is precisely as long as that required for the transfer of the yarn. In that case there is a match between the time X, at which the yarn connection has been re-established, and the time B, at which the yarn transfer begins. Accordingly there is no waiting time $t_w$. The prerequisite for this ideal case is that the time elapsed since the most recent pulse emission is equal to the difference between the time for one round trip or a multiple of that time, and the transfer time.

The third example applies to the case in which the yarn connection is re-established at a time X, at which the time remaining for the yarn guide until it reaches the reversal point is less than the time required for the transfer of the yarn. In that case, the time elapsed since the most recent pulse emission is greater than the difference between the time for one round trip of the yarn guide, or a multiple thereof, and the time required for the transfer of the yarn. Accordingly, if the remaining time is shorter than the time required for the transfer of the yarn, then the next pulse is first waited for. The waiting time accordingly elapses beyond the next pulse to the time B, at which the remaining time for the yarn guide until it reaches the transfer point matches the time required for the transfer of the yarn. It is not until that instant, or in other words after the next subsequent pulse, that the yarn transfer begins.

During the waiting time $t_w$, the yarn must not be wound onto the takeup bobbin, because otherwise a slub would be created on the bobbin because of the absence of the transverse motion. The waiting time is the easiest to span on bobbin winders, because during that period only the payout of the yarn from the yarn supply point needs to be stopped. In contrast, in spinning machines, provisions must be made to prevent yarn supply during the waiting period $t_w$. One option is to interrupt the feeding of fibers into the station and to stop the payout of the yarn. Another option is to delay feeding in the fibers for forming the piecer until the waiting time $t_w$ has elapsed. During the waiting period, it is accordingly necessary that no yarn be drawn from the spinning station.

In open-end spinning machines, above all, an attempt should therefore be made to achieve the ideal state, as shown in the second case in FIG. 1. Both the piecing time required and the time for transferring yarn to the yarn transfer device are precisely set, for reasons of both automation and mechanical processes. They are only dependent on the yarn parameters, for which the piecing mechanics can be adjusted. These times can be stored in a memory of a control apparatus of the open-end spinning machine and can be called up as needed. For instance, if a cotton yarn of a particular yarn count is to be pieced again, then for this purpose a very specific, set time is needed from the return to the spinning station until the payout of the pieced yarn and transfer to the yarn transfer device. This time can be added to the transfer time tü, so that the waiting period no longer occurs between the making of the yarn connection and the beginning of the yarn transfer. The beginning of the making of the yarn connection is already included in the elapsing time. The making of the yarn connection accordingly begins as a function of a pulse signal from the yarn guide, after a possible waiting period $t_w$ has elapsed.

An apparatus for performing the method according to the invention will be described in further detail below in terms of an exemplary embodiment. This apparatus is installed on an open-end spinning machine, and specifically a rotor spinning machine. However, regardless of this exemplary embodiment, such an apparatus can also be installed in any winding station of another textile machine.

FIGS. 2-5 show the transfer of a yarn in a rotor spinning machine in the various stages from the payout of the yarn by the spinning station through the piecing apparatus until the yarn guide takes up the yarn.

In FIG. 2, the spinning station of a rotor spinning machine and the associated winding station are shown and identified by reference numeral 1. A piecing apparatus 21 is positioned facing the spinning and winding station. Only those parts of the rotor spinning machine that contribute to a comprehension of the invention are shown. Thus it is not shown, for instance, how the piecing apparatus is disposed in mobile fashion on the machine frame.

Sliver 3 is introduced into a spinning box 2 at the spinning station 1 which provides a yarn supply point. The sliver is separated by a separating fixture in a non-illustrated manner and is aspirated into a rotor 4, where it is spun into a yarn 5*a* in a known manner, the yarn being paid out of the spinning box through a yarn payout tube 6.

In the present exemplary embodiment shown in FIG. 2, the normal yarn travel to a takeup bobbin in the form of a cross-wound bobbin or cheese 7, has been interrupted. The yarn connection between the cheese and the spinning station has been re-established by the piecing apparatus 21. The transfer of the yarn to the normal yarn travel position must then be effected. The yarn 5*a* runs up onto the cheese 7 to be wound, which is carried by a bobbin holder 8. The bobbin holder 8 is pivotably supported in a pivot joint 9 thereof on a machine frame of the open-end spinning machine. During normal winding operation, the cheese 7 rests on a drive roller 10, and the yarn is deposited in cross-wound layers on the bobbin by means of a yarn guide 11. The transverse motion of the yarn guide 11 is effected with the aid of a yarn guide rod 12. The yarn guide rod extends over the entire length of the machine, it carries all of the yarn guides of the various winding stations and it is driven centrally. However, the use of a yarn guide with its own separate drive mechanism is also possible. In terms of performing the method according to the invention, there is no difference whether the yarn guide is driven centrally through a yarn guide rod or individually by a separate drive mechanism. If the yarn guide is centrally driven through a yarn guide rod along the entire machine as is the case, for instance, in rotor spinning machines, then the yarn guide need only be observed at a single spinning station.

During the spinning process, the yarn must be drawn from the spinning station. This is performed by a takeup apparatus, which includes a driven takeup roller 13 and a clamping roller 14. The takeup apparatus is disposed over the spinning box 2, above the yarn payout tube 6. The clamping roller 14 is mounted on the end of a pivot lever 15, which is supported at a pivot point 15*a*. The pivot lever 15 can be pivoted in such a way that the clamping roller 14 is lifted from the takeup roller 13 and thus releases the yarn so that it is no longer taken up by the takeup roller. The presence of the yarn is monitored by a yarn monitor 16, which includes a pivotable yarn monitor wire 17 and a contact 18. If the yarn is being wound onto the cheese 7, then during the bobbin travel it is under tension and lifts the yarn monitor wire 17 from the contact 18. If the yarn breaks and accordingly is absent, the yarn monitor wire 17 drops onto the contact 18. As a result, the yarn break is reported through a signal line 19 to a control apparatus 39, which thereupon sends a signal over a signal line 40 and stops the introduction of the sliver 3 into the spinning box 2, so that no new yarn can be spun. At the same time, the bobbin holder 8 is pivoted upward far enough to ensure that the cheese 7 is lifted from the drive roller 10, over a signal line 41 and a non-illustrated apparatus which is known from the prior art.

At the same time, a signal is sent to the piecing apparatus 21 over a signal line 38, and the piecing apparatus is thus ordered to establish a new yarn connection at the malfunctioning spinning station.

The piecing apparatus 21 includes all of the equipment necessary for the process of piecing the yarn, re-establishing the yarn connection, and transferring the yarn to the spinning station in the normal yarn travel position. This equipment is known from German Patent DE-PS No. 26 20 805 which was already referred to above. For this reason, only the equipment necessary for transferring the yarn to its normal yarn travel position is shown and described in detail herein.

Once the yarn connection has been re-established by the piecing apparatus 21, the yarn 5*a* must first also be withdrawn from the piecing apparatus itself. The payout of the pieced yarn 5*a* from the spinning box 2 is effected by means of a payout device on the spinning apparatus 21, including a takeup roller 26 and a clamping roller 27. As soon as the takeup roller 26 rotates in the direction of takeup of the yarn, which is reported to a control apparatus 33 over a signal line 26*b*, the yarn connection is considered to be established. This is the instant indicated by reference symbol X in the flow chart of FIG. 1. The control apparatus calculates the remaining time until the arrival of the yarn guide at the transfer point.

A yarn transfer device 29 must then remain in the position shown in FIG. 4B until the time $t_w$ corresponding to the flow chart of FIG. 1 has elapsed. The waiting period is also reported to the control apparatus 33 through the control apparatus 39. During this period, the supplying of yarn must be interrupted. The interruption in yarn supply can be dispensed with if, as already mentioned, the making of the yarn connection and the yarn transfer proceed in succession, while being chronologically matched to one another, and if the time for the yarn connection, that is the time for piecing, is added to the transfer time. The beginning of piecing is then initiated by the control apparatus in response to a pulse tripped by the yarn guide, while optionally taking a waiting period into account beforehand.

Once the time B of the flow chart of FIG. 1 has arrived, the yarn transfer begins, which as already noted in the description of the flow chart of FIG. 1 includes a technically specified and precisely set time $t_{ü}$. During this time, the yarn transfer device 29 pivots toward a transfer point 44 and places the yarn 5 into the path of the yarn guide 11, which has moved in the direction of the arrow to a reversal point and sensor 42 seen in FIG. 5*b*.

Since the cheese 7 has been raised from its drive roller 10, it is driven by the piecing apparatus 21 in order to wind up the yarn. The piecing apparatus has a drive arm 22, which is rotatably supported on the piecing apparatus in a pivot joint 23. Mounted on the head of the drive arm 22 is a drive roller 24, which is driven through a chain 25. The drive, which is not shown herein, is controlled over a signal line 23*a* by the control apparatus 33 of the piecing apparatus 21. If the cheese 7 is to be driven by the piecing apparatus 21, then the drive arm 22 rests with its drive roller 24 against the cheese. The drive roller 24 is then rotated by the chain 25 in the direction of the arrow in such a way that the yarn is wound up onto the cheese.

In FIG. 2, a continuous connection of a yarn 5*a* from the rotor 4 of the spinning box 2 up to the cheese 7 already exists. The yarn 5*a* is also withdrawn from the piecing apparatus 21 by the takeup roller 26 but has already been transferred to the yarn transfer device 29 in order for it to be transferred to the takeup apparatus of the spinning station. To this end, the control apparatus 33 in the piecing apparatus 21 emits a signal to the takeup apparatus, over a signal line 28*b*, in order to open the clamping roller 27. The clamping roller 27 is lifted from the takeup roller 26 by means of a pivot lever 28 which pivots about a pivot point 28*a*. Due to the yarn tension, the yarn assumes a course 5*b*. It is then in contact with the takeup roller 13, and upon the transmission of a signal from the control apparatus 39 of the open-spinning machine to the takeup apparatus over a signal line 15*b*, the clamping roller 14 is pivoted by the pivot lever 15 onto the takeup roller 13. The takeup roller 13 is switched on over a signal line 13*b*. The takeup apparatus of the spinning station is thereupon in operation and it draws the yarn out of the yarn payout tube. The payout speed is equivalent to the payout speed during normal bobbin travel.

In order to return the yarn to its normal yarn travel position, the yarn transfer device 29 then pivots toward the spinning station, under the tension of the yarn. The cheese 7 is driven at increased rpm by the drive arm 22, in order to use up the yarn reserve created by the piecing process.

This situation is shown in FIG. 3*a*, wherein the yarn assumes the course 5*b*. It is paid out at the spinning station 1 by the takeup apparatus having the takeup roller 13 and clamping roller 14, and wound onto the cheese 7, which is driven by the drive arm 22.

The yarn tension causes pivoting of the yarn transfer device 29 about a pivot axis 30 thereof counter to the force of a restoring spring 31. On one hand, the restoring spring 31 serves to restore the yarn transfer device 29 to its outset or initial position, and on the other hand it generates the yarn tension desirable for the winding process during the transfer process.

In FIG. 3*a*, the yarn transfer device 29 is on the way to transferring the yarn to the normal yarn travel position. The yarn transfer device 29 has already moved away from its initial position in FIG. 2, in which the yarn had been transferred to it. The motion of the yarn transfer device 29 is recorded by three sensors 34, 35 and 36, serving as a means for monitoring the delivery motion. These sensors may be opto-electric sensors, or other sensors, such as magnetic sensors, may be used instead.

The initial position of the yarn transfer device 29 seen in FIG. 2 is recorded with the of the sensor 34 and reported through a signal line 34*a* thereof to the control apparatus 33. If the yarn transfer device 29 pivots out of range of the sensor 34, this is likewise reported to the control apparatus 33.

FIG. 3*b* shows the yarn transfer apparatus from above. Any parts of the piecing apparatus 21 and spinning station 1 that could unnecessarily complicate the drawing have been left out.

In its outset or initial position, the yarn transfer device 29 is pivoted all of the way back, so that a reflector 37 on the yarn transfer device is located directly opposite the opto-electric sensor 34.

The pivot axis 30, about which the yarn transfer device 29 is pivoted, is disposed obliquely relative to the bobbin axis. This prevents the yarn from being deposited at the same point on the bobbin each time during the yarn transfer. The yarn transfer to the yarn guide accordingly always takes place toward one of the reversal points of the yarn guide. If the yarn transfer device 29 is then moving toward the transfer point during the transfer of the yarn to the yarn guide, then the yarn is deposited in parallel layers 71, side by side, on the cheese because of the oblique disposition of its pivot axis 30.

During this process, the yarn guide 11 travels back and forth between its two reversal points, that is, the left reversal point and sensor 42 and a right reversal point and sensor 43. The two reversal points are marked by the sensors, as means for monitoring the transverse motion of the yarn guide. These sensors may respond to optical or magnetic influences. Upon reaching a reversal point, the yarn guide covers the sensors with a lug, vane or web 11*a* or 11*b* thereof. The left sensor 42 is covered by the lug 11*a* once it reaches the left reversal point. This signal is sent to the control apparatus over a signal line 42*a*. Once the yarn guide reaches the right reversal point 43, its right lug 11*b* covers the sensor 43. This signal is likewise reported to the control apparatus 39, over a signal line 43*a*. In FIG. 3*b*, the yarn guide is just moving toward the right reversal point 43, as indicated by an arrow. Then its right lug 11*b* will cover the sensor 43, so that a signal will be reported to the control apparatus 39 over the signal line 43*a*.

With the aid of suitable memory means, the control apparatus 39 is in a position to detect and store the times of a respective round trip of the yarn guide and to ascertain the direction in which the yarn guide is moving between two pulses, from the signals received from the sensors. The control apparatus also includes a computer, which makes it possible to calculate the time remaining until the transfer point is reached, during one round trip or multiple round trips, of the yarn guide. The transfer point 44 is the maximum point reached by a transfer roller 32 when the yarn is transferred to the yarn guide 11 by the yarn transfer device 29.

The course of the transfer of the yarn to the yarn guide can be precisely controlled chronologically, by an exchange of data between the two control apparatuses over the signal line 38 with which the control apparatus 33 of the piecing apparatus communicates with the control apparatus 39 of the spinning station or of the entire open-end spinning machine, so that this process is equivalent to one of those illustrated in FIG. 1 and described in conjunction therewith. The two control apparatuses can also be combined into one joint control apparatus. Such an apparatus could, for instance, be centrally disposed in the textile machine and connected both to the various spinning and winding stations and to the piecing apparatus by control and signal lines.

It is particularly advantageous not to begin making the yarn connection until its course over time and the yarn transfer produce a predeterminable time, which begins in response to a pulse tripped by the yarn guide, while optionally taking a waiting period $t_w$ into account.

In FIGS. 4*a* and 4*b*, the reflector 37 of the yarn transfer device 29 is located opposite the sensor 35. This situation is reported to the control apparatus 33 over a signal line 35*a*. The control apparatus 39 also receives a pulse over the signal line 38, which tells it the following information: The yarn reserve created by the re-establishment of the yarn connection has been used up. Yarn winding must then be performed at the winding speed specified by the drive roller 10. The control apparatus 39 thereupon acts over the signal or control line 41 and causes the lowering of the bobbin holder 8, so that the cheese 7 comes to rest on the drive roller 10. At the same time, the control apparatus 33 acts over the signal or control line 23*a* and causes the drive arm 22 to pivot back away from the cheese 7. The drive roller 24 is stopped.

FIGS. 5*a* and 5*b* show the instant at which the yarn has been transferred to a normal yarn travel position 5*c* thereof at the yarn guide of the winding station.

The transfer roller 32 of the yarn transfer device 29 has reached the transfer point 44, after the transfer time $t_{ü}$ has elapsed. The control apparatus 39 has acted over a signal line 20*a* to cause the yarn lifter wire to fold downward. The yarn lifter wire 20 had previously prevented the yarn from reaching the vicinity of the yarn guide 11 during the transfer. The yarn lifter wire 20 is then located below the transfer roller 32. Upon the arrival of the transfer roller 32 at the transfer point 44, the yarn lifter wire pushes the yarn off the transfer roller, and the yarn drops into the vicinity of the yarn guide 11. The yarn guide engages the yarn 5*c*, as can be seen in FIG. 5*b*. The yarn is carried along by the yarn guide and follows its transverse motions. Its deposition in the desired cross winding take place as a result. The yarn transfer device 29 is then located in its most extreme pivoted position. This is recorded with the aid of the sensor 36. On the basis of the signal of the sensor 36, the piecing apparatus 21 is caused to retract the yarn transfer device 29, to pivot the drive arm 22 back into its outset or initial position, and to shut off the chain drive 25. Once these method steps have been executed, the piecing apparatus 21 can turn to another spinning station that is undergoing a malfunction, for instance a yarn break.

We claim:

1. Method for transferring a yarn after a yarn break to a normal yarn travel position at a textile machine winding station having a reciprocating yarn guide with a transverse motion, which comprises making a yarn connection between a yarn supply point and a takeup bobbin, providing an apparatus that re-establishes yarn travel with a yarn transfer device movably mounted thereon, subsequently transferring the yarn to the normal yarn travel position at a transfer point at the reciprocating yarn guide with a transfer motion of the yarn transfer device, monitoring the chronological course of the making of the yarn connection and the transverse motion of the yarn guide, and adapting the transfer motion of the yarn transfer device at the transfer point to the transverse motion of the yarn guide as a function of the time required by the machine for making a yarn connection and of the time required by the machine during the transfer motion of the yarn transfer device and the time remaining before the arrival of the yarn guide at the transfer point for causing the yarn and the yarn guide to substantially simultaneously arrive at the transfer point of the yarn.

2. Method according to claim 1, which comprises initiating the transfer of the yarn to the yarn guide whenever the time remaining until the transfer point is reached is equal to the time required for the transfer motion of the yarn transfer device to the transfer point, during a round trip, a double stroke, or an integral multiple of a round trip of the yarn guide.

3. Method according to claim 2, which comprises detecting the reciprocating motion of the yarn guide with sensors; emitting pulses from the sensors upon detecting a reciprocating motion of the yarn guide; ascertaining the time for one round trip and ascertaining the direction of the motion of the yarn guide with the pulses; and initiating the transfer of the yarn by the yarn transfer device toward the transfer point as a function of a given number of pulses, having a total duration equal to the required time for the motion of the yarn transfer device to the transfer point.

4. Method according to claim 1, which comprises detecting the reciprocating motion of the yarn guide with sensors; emitting pulses from the sensors upon detecting a reciprocating motion of the yarn guide; ascertaining the time for one round trip and ascertaining the direction of the motion of the yarn guide with the pulses; and initiating the transfer of the yarn by the yarn transfer device toward the transfer point as a function of a given number of pulses, having a total duration equal to the required time for the motion of the yarn transfer device to the transfer point.

5. Method according to claim 1, which comprises transferring the yarn to the yarn guide at the same transfer point each time.

6. Method according to claim 1, which comprises locating the transfer point at a slight distance as compared to the transfer motion before a reversal point of the yarn guide.

7. In a textile machine having a winding station with a yarn supply point, a takeup bobbin, and a reciprocating yarn guide for the takeup bobbin, an apparatus for transferring a yarn to a normal yarn travel position after a yarn break, comprising first means for monitoring reciprocation of the yarn guide to a yarn transfer point and issuing signals; signal lines connected to said first means; second means connected to said signal lines for detecting and processing the signals, ascertaining the time still remaining for the yarn guide to reach the yarn transfer point and issuing other signals; third means for re-establishing a yarn connection between the takeup bobbin and the yarn supply point, said third means having a yarn transfer device mounted on the apparatus and movable toward the yarn transfer point for transferring the yarn to the normal yarn travel position at the transfer point, said third means having fourth means for chronologically adapting the making of the yarn connection to the arrival of the yarn guide at the transfer point; another signal line connected between said second and fourth means for initiating the transfer motion of the yarn transfer device as a function of the other signals.

8. Apparatus according to claim 7, wherein said first means for monitoring the reciprocation of the yarn guide are pulse-emitting sensors.

9. In a textile machine having a winding station with a yarn supply point, a takeup bobbin, and a reciprocating yarn guide for the takeup bobbin, an apparatus for transferring a yarn to a normal yarn travel position after a yarn break, comprising first means for monitoring reciprocation of the yarn guide to a yarn transfer point and issuing signals; second means connected to said first means for detecting and processing the signals, ascertaining the time still remaining for the yarn guide to reach the yarn transfer point and issuing other signals; third means for re-establishing a yarn connection between the takeup bobbin and the yarn supply point, said third means having a yarn transfer device mounted on the apparatus and movable toward the yarn transfer point for transferring the yarn to the normal yarn travel position at the transfer point, and said third means having fourth means connected to said second means for chronologically adapting the making of the yarn connection to the arrival of the yarn guide at the yarn transfer point and initiating the transfer motion of the yarn transfer device as a function of the other signals.

* * * * *